US011655123B2

(12) United States Patent
Cambruzzi et al.

(10) Patent No.: US 11,655,123 B2
(45) Date of Patent: May 23, 2023

(54) INSTALLATION DEVICE AND METHOD BRINGING AN INSTALLATION DEVICE INTO AN INSTALLATION POSITION IN AN ELEVATOR SHAFT

(71) Applicant: Inventio AG, Hergiswil (CH)

(72) Inventors: Andrea Cambruzzi, Zurich (CH); Eliza Olczyk, Lucerne (CH); Erich Bütler, Ebikon (CH); Raphael Bitzi, Ebikon (CH); Philipp Zimmerli, Härkingen (CH)

(73) Assignee: INVENTIO AG, Hergiswil (CH)

( * ) Notice: Subject to any disclaimer, the term of this patent is extended or adjusted under 35 U.S.C. 154(b) by 541 days.

(21) Appl. No.: 16/640,390

(22) PCT Filed: Sep. 11, 2018

(86) PCT No.: PCT/EP2018/074356
§ 371 (c)(1),
(2) Date: Feb. 20, 2020

(87) PCT Pub. No.: WO2019/052970
PCT Pub. Date: Mar. 21, 2019

(65) Prior Publication Data

US 2020/0354197 A1 Nov. 12, 2020

(30) Foreign Application Priority Data

Sep. 13, 2017 (EP) ..... 17190944

(51) Int. Cl.
*B66B 19/00* (2006.01)
*E04G 21/14* (2006.01)
(Continued)

(52) U.S. Cl.
CPC ..... *B66B 19/00* (2013.01); *B66B 7/023* (2013.01); *B66B 9/187* (2013.01); *E04G 21/14* (2013.01)

(58) Field of Classification Search
CPC ..... B66B 19/00; B66B 9/187; B66B 7/023; E04G 1/367
See application file for complete search history.

(56) References Cited

U.S. PATENT DOCUMENTS 5,033,586 A * 7/1991 Richards ..... B66B 19/00 187/259
8,636,115 B2 * 1/2014 Peacock ..... B66B 19/00 187/254
(Continued)

FOREIGN PATENT DOCUMENTS

CN 201478117 U 5/2010
CN 204426504 U 7/2015
(Continued)

*Primary Examiner* — Michael R Mansen
*Assistant Examiner* — Michelle M Lantrip
(74) *Attorney, Agent, or Firm* — William J. Clemens; Shumaker, Loop & Kendrick, LLP

(57) ABSTRACT

An installation device used in an elevator shaft has a first carrier with first and second carrier ends, a support element pivotably arranged on the first carrier end, and a holding apparatus holding a displacement apparatus by which installation material can be displaced in the elevator shaft. When the installation device is in an installation position, the first carrier end is supported against a threshold of an elevator shaft door opening by the support element and the second carrier end is supported at least indirectly against a shaft wall that is opposite the door opening. The holding apparatus is arranged on an upper side of the installation device in the installation position such that the displacement apparatus is supported from above on the holding apparatus.

9 Claims, 3 Drawing Sheets

(51) Int. Cl.
*B66B 7/02* (2006.01)
*B66B 9/187* (2006.01)

(56) References Cited

U.S. PATENT DOCUMENTS

| | | | | |
|---|---|---|---|---|
| 8,646,224 | B2 | 2/2014 | Wurth | |
| 9,834,415 | B2 * | 12/2017 | Hense | B66B 19/00 |
| 10,024,488 | B2 * | 7/2018 | Wurth | F16M 13/02 |
| 10,836,608 | B2 * | 11/2020 | Peacock | B66B 5/005 |
| 2011/0113720 | A1 * | 5/2011 | Peacock | B66B 19/00 187/254 |
| 2016/0152442 | A1 * | 6/2016 | Weber | B66B 19/005 187/359 |

FOREIGN PATENT DOCUMENTS

| | | | | |
|---|---|---|---|---|
| EP | 2636629 | A1 | 9/2013 | |
| JP | 2011225336 | A | 11/2011 | |
| WO | WO-2012089896 | A1 * | 7/2012 | B66B 11/00 |
| WO | 2017016783 | A1 | 2/2017 | |

* cited by examiner

INSTALLATION DEVICE AND METHOD BRINGING AN INSTALLATION DEVICE INTO AN INSTALLATION POSITION IN AN ELEVATOR SHAFT

FIELD

The invention relates to an installation device for use in an elevator shaft and to a method for bringing an installation device into an installation position in an elevator shaft.

BACKGROUND

U.S. Pat. No. 8,646,224 B2 describes an installation device for use in an elevator shaft, which has a carrier comprising a first carrier end and a second carrier end. A support element is pivotably arranged on the first carrier end, by means of which element the carrier can be supported against a threshold of a door opening of the elevator shaft when the installation device is in an installation position. By means of the second carrier end, the carrier is supported against a shaft wall that is opposite said door opening of the elevator shaft when the installation device is in an installation position. The length of the carrier is greater than the distance between the shaft wall and the threshold of the door opening, and therefore, in the installation position, the carrier is arranged in the elevator shaft so as to be inclined with respect to the horizontal. The installation device has openings from which a displacement apparatus, for example in the form of an electric winch, can be suspended by means of a cable. The displacement apparatus is thus always suspended downwardly in the elevator shaft below the carrier and thus below said openings.

EP 2636629 A1 and JP 2011225336 A also describe installation devices for use in an elevator shaft.

In order to bring the installation device into the installation position, it is pulled upward inside the elevator shaft by means of a displacement device that is secured above the door opening, for example in a shaft head of the elevator shaft, until the support element can be secured to the threshold of the door opening, for example by means of screws. Subsequently, the installation device can be pivoted toward the shaft wall that is opposite the door opening until it can be supported against the shaft wall and has thus reached the installation position. When the installation device is being pulled upward, a displacement apparatus is not yet arranged on the installation device. The displacement apparatus is attached to the installation device only after the securing to the threshold of the door opening, and therefore this work has to take place inside the elevator shaft. For this purpose, the displacement device can again be used, for example, by means of which device the installation device is pulled upward in the elevator shaft.

Against this background, an object of the invention is in particular to propose an installation device which can be easily and in particular safely brought into an installation position, and to propose a simple and in particular safe method for bringing an installation device into an installation position.

SUMMARY

The installation device according to the invention for use in an elevator shaft has a first carrier, which comprises a first carrier end and a second carrier end, a support element, which is pivotably arranged on the first carrier end, and a holding apparatus for holding a displacement apparatus, by means of which installation material can be displaced in the elevator shaft. The support element is designed and arranged such that, when the installation device is in an installation position, the first carrier can be supported in the region of a door opening, in particular against a threshold of a door opening of the elevator shaft, by means of the support element. The second carrier end is designed such that, when the installation device is in the installation position, the first carrier can be supported at least indirectly against a shaft wall that is opposite said door opening of the elevator shaft by means of the second carrier end. The holding apparatus for holding the displacement apparatus is designed and arranged on an upper side of the installation device when said installation device is in the installation position such that a displacement apparatus held by the holding apparatus is supported from above on the holding apparatus when the installation device is in the installation position. The holding apparatus is arranged in particular in the region of the first carrier end.

According to the invention, the installation device has a deflection roller which is designed and arranged such that it can deflect a load-bearing means of a displacement apparatus held by the holding apparatus. The position of the load-bearing means in the elevator shaft is thus determined by the position of the deflection roller. The position of the displacement apparatus can therefore be selected largely independently of a position of the load-bearing means in the elevator shaft. In particular, the displacement apparatus can thus be arranged in the region of the first end of the carrier, without the load-bearing means also extending directly along a shaft wall of the elevator shaft.

When the installation device is in the installation position, the deflection roller is arranged in particular approximately in the center of the elevator shaft. The deflection is thus in particular such that the load-bearing means is deflected vertically downward approximately centrally in the elevator shaft.

The design and arrangement of the holding apparatus according to the invention makes it possible to arrange the displacement apparatus on the holding apparatus from above from the floor associated with the door opening when the installation device is in the installation position. In particular, the displacement apparatus can first be placed on the holding apparatus in the region of the first end of the carrier and then pushed into its correct position by means of the holding apparatus and optionally the first carrier. The displacement apparatus can thus be arranged from the floor and thus from outside the elevator shaft. It is therefore not necessary for this purpose for a technician to go into the elevator shaft, which is always associated with a certain level of risk. Furthermore, no further displacement device has to be provided in the elevator shaft by means of which the displacement apparatus provided for the installation device can be displaced in the elevator shaft.

The displacement apparatus provided for the installation device is designed in particular as an electric winch, which can be controlled by a control device. The displacement apparatus interacts with a load-bearing means, which may be designed, for example, as a cable, a belt or a chain. When the installation device is mounted in an elevator shaft, the load-bearing means of the displacement apparatus extends downward in the elevator shaft. The displacement apparatus is not a necessary component of the installation device according to the invention, but rather only an optional component thereof.

The installation device can be used in particular during the installation of an elevator system in an elevator shaft. It can be used advantageously in particular if the elevator system does not have a machine room arranged above the elevator shaft or if the elevator shaft is so high that an installation device has to be arranged at different heights during installation of the elevator system. By means of a displacement apparatus arranged on the installation device, installation material which is required during the installation can be displaced in the elevator shaft. The installation material may be, for example, guide rails which are secured to shaft walls and used to guide an elevator car. It is also possible for a work platform on which technicians can perform installation work to be displaced in the elevator shaft by means of the displacement apparatus. In particular, the installation device according to the invention is used to displace an automated mounting apparatus for carrying out installations in an elevator shaft, as described, for example, in WO 2017/016783 A1.

The first carrier is designed as an element that is elongated in an extension direction of the installation device and consists in particular of metal. It is also possible for the first carrier to consist of a different material, for example a reinforced plastics material or carbon. For example, the first carrier may be mainly composed of a T-bar, a double-T bar, or a tube.

The support element is pivotably arranged on the first carrier end of the first carrier, the associated pivot axis extending in particular perpendicularly to the extension direction of the first carrier and extending horizontally when the installation device is in the installation position. The support element has in particular two abutment elements which form a right angle. The abutment elements are designed and arranged such that, when the installation device is in the installation position, one abutment element abuts a base of a threshold of a door opening, and the other abutment element abuts the shaft wall that adjoins the threshold. The abutment elements have in particular through-holes, by means of which said elements and thus the support element can be screwed to the base or the shaft wall. When the first carrier is supported against the threshold of the door opening by means of the support element and in particular when the support element is secured to the threshold, the first carrier can be pivoted into the elevator shaft about said pivot axis. It is also possible for the support element to only have one abutment element, by means of which the support element can be secured to the base of the threshold of a door opening and the other element can be secured to the shaft wall that adjoins the threshold and thus in the region of the door opening.

Here, the installation position of the installation device should be understood to mean the position of the installation device in which it can be used for installing an elevator system in the elevator shaft. In the installation position, the first carrier is supported against the threshold of a door opening of the elevator shaft by means of the first support element, the support element being secured in particular to the threshold as described above. In addition, the first carrier is supported at least indirectly against a shaft wall that is opposite said door opening of the elevator shaft by means of the second carrier end. In this case, indirect support should be understood to mean that a further support element is arranged on the second carrier end, by means of which element the second carrier end is supported against the shaft wall. It is also possible for the second carrier end to be supported directly against the shaft wall. The second carrier end is supported in particular at a height above said threshold, and therefore the first carrier is arranged so as to be upwardly inclined proceeding from the threshold. The shaft wall that is opposite the door opening can also have a shoulder against which the first carrier can rest. The first carrier can thus also be arranged horizontally or so as to be downwardly inclined proceeding from the threshold.

The holding apparatus for holding the displacement apparatus forms in particular a mainly flat surface on which at least one part of the displacement apparatus is positioned when the installation device is in the installation position, and said part is thus supported from above on the holding apparatus. Said holding apparatus can be designed as a separate component which is connected to the carrier. The holding apparatus can also be formed in one piece with the carrier, i.e. as an integral component of the carrier.

In one embodiment of the invention, the holding apparatus for holding the displacement apparatus comprises at least one first alignment element which is designed and arranged such that it interacts with a second alignment element of the displacement apparatus when the displacement apparatus is in a correct mounting position relative to the holding apparatus. This can advantageously ensure that the displacement apparatus is arranged on the holding apparatus in the correct mounting position.

The first alignment element is in particular designed as a recess or opening into which the second alignment element designed as an extension is inserted when the displacement apparatus is positioned correctly relative to the holding apparatus. The extension may be designed, for example, as a pin or be formed by bending over part of a bottom plate of the displacement apparatus or a mounting plate arranged on the displacement apparatus. Said mounting plate is, for example, screwed to the displacement apparatus from below and can be formed in one piece or in multiple pieces. When said mounting plate is connected to the displacement apparatus, i.e. screwed thereto for example, it can be considered to be part of the displacement apparatus.

It is also possible for the first alignment element to be designed as an extension and for the second alignment element to be designed as a recess.

In one embodiment of the invention, the installation device comprises a displacement apparatus held by the holding apparatus. The displacement apparatus thus forms part of the installation device.

In one embodiment of the invention, the displacement apparatus has at least one guide element which is designed and arranged such that it interacts with a guide of the installation device when the displacement apparatus is arranged on the holding apparatus. A plurality of guide elements and a plurality of guides can also be provided. The displacement apparatus can thus be securely arranged on the holding apparatus, i.e. without the risk of the displacement apparatus slipping down from the installation device and, in the worst case scenario, falling down the elevator shaft. In addition, the displacement apparatus can be particularly easily brought into the correct position relative to the holding apparatus.

The guide element can be designed, for example, as an extension and the guide can be designed, for example, as a recess or opening. The extension may be designed, for example, as a pin or be formed by bending over part of a bottom plate of the displacement apparatus or a mounting plate arranged on the displacement apparatus. Said mounting plate can thus comprise in particular the above-mentioned second alignment element and the guide element. It is also possible for the guide element to be designed as a recess and for the guide to be designed as an extension.

So as to arrange the displacement apparatus on the holding apparatus, the displacement apparatus is first placed in particular on the holding apparatus or the carrier and then shifted relative to the holding apparatus until it has reached the correct position relative to the holding apparatus. The guide element and the guide interact in particular while the displacement apparatus is being shifted.

In one embodiment of the invention, the installation device has a second carrier which is arranged at a distance from and in parallel with the first carrier, and the two carriers form said guide of the installation device. The guide can thus be made particularly simply and inexpensively.

The guide element which interacts with the guide is designed in particular as an extension which is inserted into the gap between the two carriers while the displacement apparatus is being arranged and slides along the two carriers.

The second carrier is designed in particular so as to be identical to the first carrier. The two carriers are rigidly interconnected in particular by the holding apparatus and the other components of the installation device. For this purpose, the holding apparatus and the other components are rigidly connected, for example screwed or clamped, to both the first carrier and the second carrier. It is also possible, however, for the first carrier and the second carrier to be formed by a single component.

In one embodiment of the invention, the displacement apparatus has at least one sliding element which is designed and arranged such that it slides along the holding apparatus and/or the first carrier when the displacement apparatus is arranged on the holding apparatus. This provides for particularly simple shifting and thus particularly simple arrangement of the displacement apparatus on the holding apparatus.

Depending on the design of the holding apparatus, the sliding element can first slide on the holding apparatus and then on the first carrier and, if present, on the second carrier. It is also possible for the sliding element to slide only on the holding apparatus or only on the carrier(s). It is not necessary for the sliding element to slide on the holding apparatus while the displacement apparatus is being arranged as a whole.

In particular, the sliding element has a flat sliding surface which comprises a rounded portion at one edge. The edge comprising the rounded portion is arranged such that it is arranged at the front in the direction of the second carrier end when the displacement apparatus is being pushed, and the rounded portion is designed such that it is directed away from the holding apparatus or the carrier. The sliding element may be a part or component of the displacement apparatus or said mounting plate.

In one embodiment of the invention, a region of the displacement apparatus that is oriented toward the second carrier end of the first carrier is braced to the first and/or second carrier by means of a tensioning belt. A turnbuckle of the tensioning belt is arranged in particular at the top or on the side of the displacement apparatus. The tensioning belt can be tightened from the floor associated with the door opening and thus the displacement apparatus can be braced. The displacement apparatus can thus be secured particularly safely and also easily. Securing the displacement apparatus to the holding apparatus by means of screws in the region that is oriented toward the second carrier end of the first carrier would be much more complex and also more dangerous because said screws would have to be arranged on the underside of the displacement apparatus.

Said tensioning belt is thus arranged on a region of the displacement apparatus that projects into the elevator shaft. In particular, it can be placed loosely around the displacement apparatus and the carrier(s) even before the displacement apparatus has been arranged or pushed.

In addition, the displacement apparatus can also still be screwed to the first and/or second carrier in the region of the first and/or second carrier end. This region can be easily and safely accessed from the floor associated with the door opening.

The object set out above is also achieved by a method for bringing an installation device into an installation position in an elevator shaft. The installation device has a first carrier, which comprises a first carrier end and a second carrier end, and a support element, which is pivotably arranged on the first carrier end. When the installation device is in the installation position, the first carrier is supported against a threshold of a door opening of the elevator shaft by means of the first support element and is supported at least indirectly against a shaft wall that is opposite said door opening of the elevator shaft by means of the second carrier end. According to the invention, the method comprises the following steps:

- suspending the installation device in the region of a top of the door opening such that the first carrier end is arranged outside the elevator shaft and the second carrier end is arranged in the elevator shaft,
- moving the first carrier end toward the elevator shaft,
- securing the support element to the threshold of the door opening, and
- pivoting the installation device until the second carrier end is supported at least indirectly against the shaft wall that is opposite the door opening.

By means of the method according to the invention, the installation device can be brought into the installation position from the floor associated with the door opening. All method steps can be carried out from said floor, without a technician having to go into the shaft. Furthermore, it is not necessary to provide a further displacement apparatus in the elevator shaft. The installation device can thus be particularly easily and safely brought into the installation position. The steps mentioned are carried out in particular in the order specified.

"Suspending the installation device in the region of a top of the door opening" should be understood in this context to mean that the installation device is suspended within or outside the elevator shaft from the top of the door opening or in the immediate vicinity of the top of the door opening by means of a load-bearing element, for example in the form of a cable or a chain, on a suspension element, for example a hook, a ring or an eyelet. A length of the load-bearing element can also be varied in particular when the installation device is suspended from said element, i.e. in what is referred to as a suspended state. The load-bearing element is designed, for example, as what is referred to as a chain pulley or a differential pulley.

After being suspended, the installation device is pivoted about said suspension in the region of the top of the door opening by moving the first carrier end toward the elevator shaft. The installation device is pivoted until the support element is arranged in a correct position for being secured to the threshold of the door opening. If necessary, the length of said load-bearing element is also varied or adapted accordingly for this purpose.

When the support element has reached the correct position, it is secured to the threshold of the door opening in particular by means of screws. In particular, in the above-mentioned position of the support element, one abutment element of the support element is located on the base of the threshold and the other abutment element is located on the shaft wall of the elevator shaft, and the two abutment elements are screwed to the base and the shaft wall, respectively, by means of one or more screws.

After the support element has been secured, the installation device is pivoted into the elevator shaft about the threshold of the door opening until the second carrier end is supported at least indirectly against the shaft wall that is opposite the door opening. Before this pivoting, said load-bearing element can in particular be removed and a cable can be attached to the installation device, for example on one or both carriers, by means of which cable the pivoting can be carried out in a controlled manner and the installation device can be pivoted back toward the door opening.

It is also possible for the installation device to first be pivoted into the elevator shaft about the threshold of the door opening and only then be secured to the threshold of the door opening.

In one embodiment of the invention, the installation device is suspended by means of a first load-bearing element and a second load-bearing element, the first load-bearing element being secured to a first suspension point and the second load-bearing element being secured to a second suspension point of the installation device, and the two suspension points being arranged so as to be spaced apart in the extension direction of the installation device. The installation device can thus be brought into its installation position in a particularly safe and controlled manner.

The lengths of the two load-bearing elements can also be varied in particular when the installation device is suspended from said elements, i.e. in the suspended state.

In one embodiment of the invention, the method comprises the following further steps:

- arranging a deflection element in the region of the threshold of the door opening such that the deflection element can deflect a third load-bearing element, which is oriented in the direction of the elevator shaft, in a direction which is directed away from the elevator shaft,
- securing a third load-bearing element in the region of the first carrier end,
- guiding the third load-bearing element around the deflection element, and
- moving the first carrier end toward the elevator shaft by pulling the third load-bearing element in the direction which is directed away from the elevator shaft.

The installation device can thus be pivoted about the above-mentioned suspension in the region of the top of the door opening in a particularly simple and controlled manner.

"Arranging a deflection element in the region of the threshold of the door opening" should be understood in this context to mean that the deflection element designed, for example, as a deflection roller is secured, for example screwed, to the shaft wall at the bottom of the door opening or in the immediate vicinity of the threshold of the door opening. Since the first carrier end is arranged outside the elevator shaft, the deflection roller is thus arranged between the first carrier end and the elevator shaft.

The third load-bearing element is also designed, for example, as a cable or a chain. Owing to the arrangement of the first carrier end, the deflection roller and the elevator shaft relative to one another, the first carrier end is moved toward the elevator shaft by pulling the third load-bearing element away from the elevator shaft.

The third load-bearing element can be guided around the deflection element before or after being secured in the region of the first carrier end. The third load-bearing element can be pulled by hand by one or more technicians. It is also possible for a technical aid in the form of a winch or a pulley to be used for this purpose.

In one embodiment of the invention, after the described steps have been successfully carried out, a displacement apparatus is arranged on the installation device. The preceding steps can thus be carried out without the comparatively heavy displacement apparatus being arranged on the installation device. The installation device can thus be particularly easily brought into the installation position.

Further advantages, features, and details of the invention will become apparent from the following description of embodiments and from the drawings in which identical or functionally identical elements are provided with identical reference signs. The drawings are merely schematic and are not to scale.

DETAILED DESCRIPTION

Figure 1:
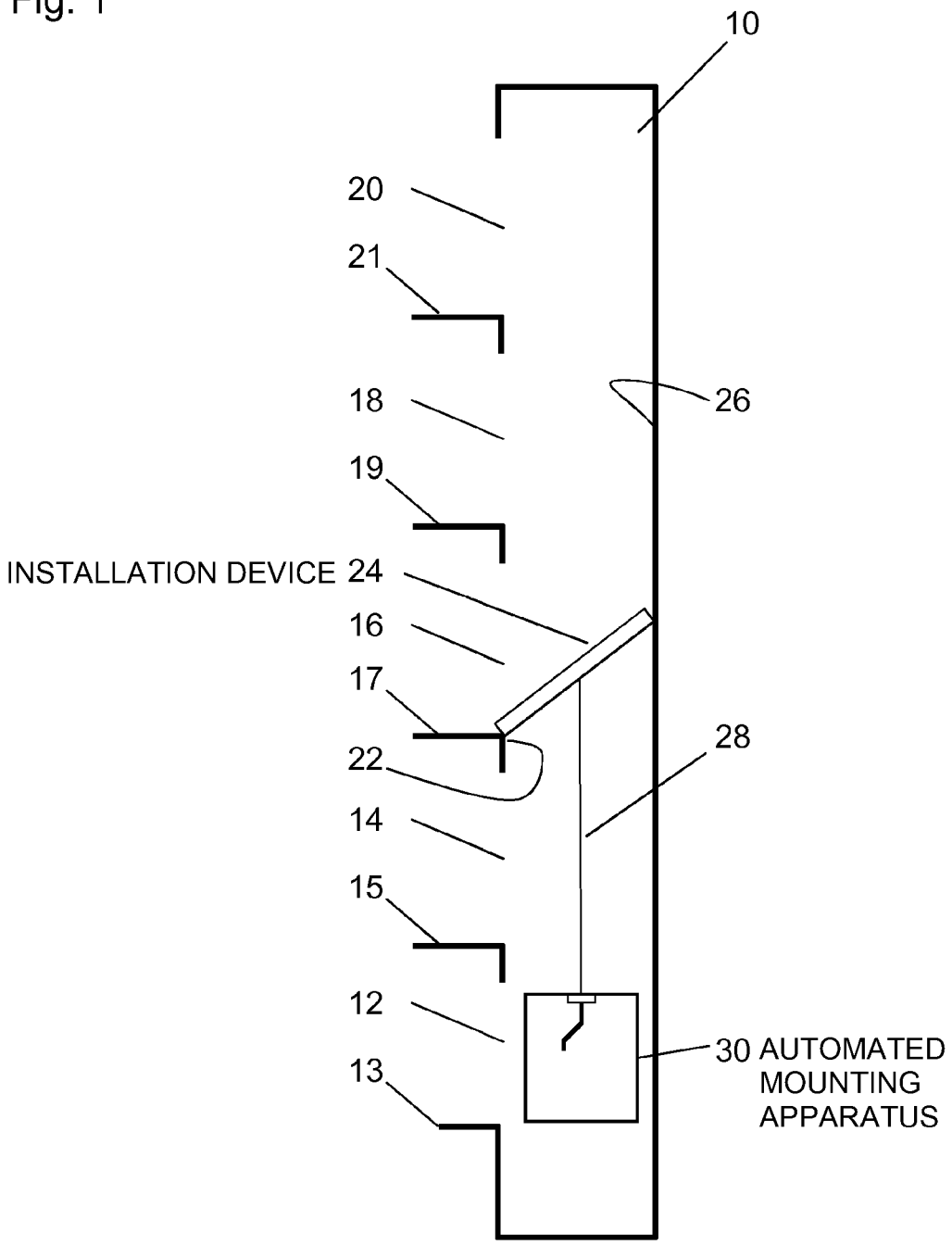
FIG. 1 shows an installation device according to the invention in an installation position in an elevator shaft and a suspended automated mounting apparatus.

According to FIG. 1, an elevator shaft 10 for an elevator system (not shown) has a first bottom door opening 12, with which a first bottom floor 13 is associated. A second floor 15 comprising a second door opening 14, a third floor 17 comprising a third door opening 16, a fourth floor 19 comprising a fourth door opening 18 and a fifth top floor 21 comprising a fifth top door opening 20 are connected from above to said first bottom floor 13.

An installation device 24 (shown in FIG. 1 in a simplified manner merely as a rectangle) is supported against a threshold 22 of the third floor 17 diagonally upward in the elevator shaft 10. The installation device 24 is also supported against a shaft wall 26 that is opposite the third shaft opening 16. By means of a lifting means 28, for example in the form of a cable or a chain, an automated mounting apparatus 30 is suspended from the installation device 24, by means of which mounting apparatus at least partially automated mounting steps can be carried out in the elevator shaft 10. The mounting apparatus 30 can be designed, for example, according to a mounting apparatus described in WO 2017/016783 A1. The mounting apparatus 30 can be displaced vertically in the elevator shaft 10 by means of a displacement apparatus (not shown in FIG. 1) of the installation device 24. The mounting apparatus 30 can thus perform mounting work at the level of the first and second floor 13, 15 when the installation device 24 is in the position in the elevator shaft 10 shown in FIG. 1.

In order for it to be possible to carry out mounting work further up in the elevator shaft 10, the installation device 24 can be brought into the installation position on the fifth floor 21. Before removing the installation device 24 on the third floor 17, the mounting apparatus 30 can be temporarily stored on the second floor 15. When the installation device 24 has been brought back into the installation position on the fifth floor 21, the mounting apparatus 30 can be brought back into the elevator shaft 10 from the second floor 15.

In reality, elevator shafts in which an installation device of this kind and an automated mounting apparatus are used comprise significantly more than 5 floors, for example at least 15 floors. The installation device can also displace the mounting apparatus in particular over more than 2 floors, for example 30 floors or approximately 100 m.

Figure 2:
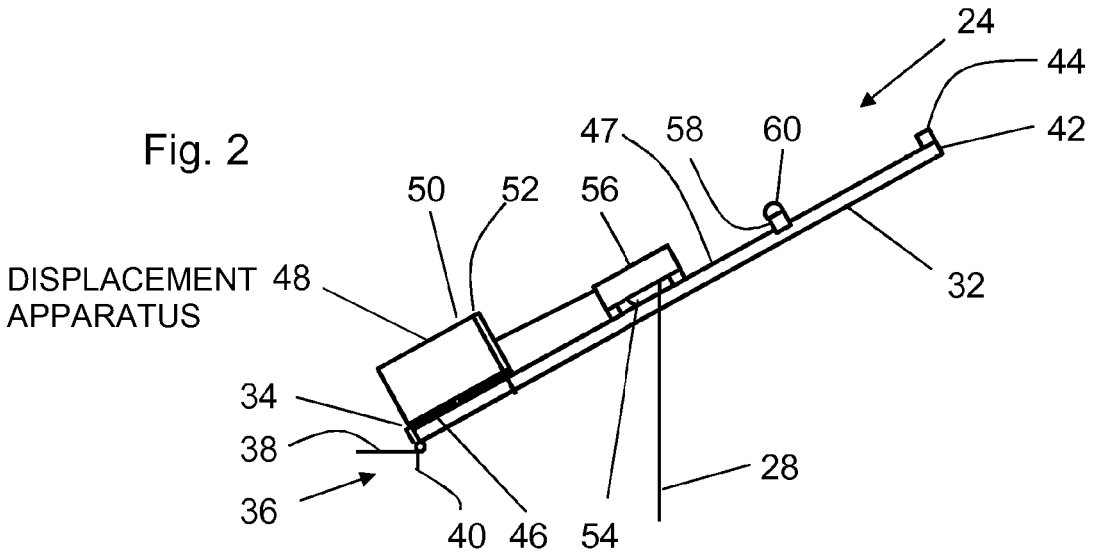
FIG. 2 is a side view of the installation device comprising a displacement apparatus.
Figure 3:
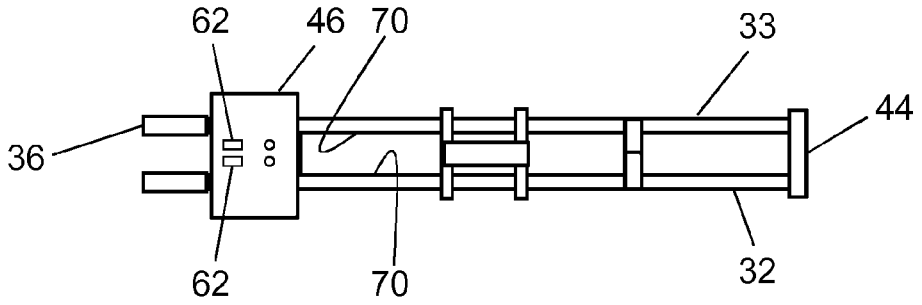
FIG. 3 is a plan view of the installation device without a displacement apparatus.

According to FIGS. 2 and 3, the installation device 24 has a first carrier 32, on the first end 34 of which a support element 36 is pivotably arranged. In FIG. 2, the pivot axis extends perpendicularly to the plane of the drawing. The support element 36 has a first flat abutment element 38 which abuts the bottom of a floor when the installation device 24 is in the installation position, and is secured to the bottom by means of screws. The support element 36 also has a second flat abutment element 40 which is arranged perpendicularly to the first abutment element 38 and abuts the shaft wall that forms the threshold together with the bottom of the floor when the installation device 24 is in the installation position, and is secured to said shaft wall by means of screws.

A second carrier 33 is arranged in parallel with and at a distance from the first carrier 32, which second carrier is constructed so as to be identical to the first carrier 32. The distance between the two carriers 32, 33 may be, for example, between 400 mm and 800 mm.

A first cross member 44 is arranged on the second carrier end 42 that is opposite the first carrier end 34, to which cross member a hanging cable (not shown) and a safety line (not shown) for actuating a safety brake of the automated mounting device can be fastened. The first cross member 44 is screwed to both carriers 32, 33 such that it ensures that there is the above-mentioned distance between the carriers 32, 33. The first cross member may also be clamped to the carriers by means of suitable fixtures in the same manner as the components of the installation device mentioned further below.

A holding apparatus 46 is arranged in the region of the first carrier end 34, which apparatus holds a displacement apparatus 48 in the form of an electric winch. The holding apparatus 46 consists of a mainly flat plate made of metal, which is screwed to the carriers 32, 33 and thus also ensures that there is the above-mentioned distance between the carriers 32, 33. In FIG. 2, the holding apparatus 46 is arranged on an upper side 47 of the installation device 24 such that it is arranged on the upper side 47 of the installation device 24 when the installation device 24 is in the installation position. The displacement apparatus 48 is arranged on the holding apparatus 46 and the two carriers 32, 33 in FIG. 2, and is thus supported from above on the holding apparatus 46 and on the carriers 32, 33 in FIG. 2 and thus when the installation device 24 is in the installation position. The holding apparatus could also be designed such that the displacement apparatus is supported exclusively on the holding apparatus. A region 50 of the displacement apparatus 48 that is oriented toward the second carrier end 42 of the first carrier 32 is braced to the first and second carrier 32, 33 by means of a tensioning belt 52.

A deflection roller 54 is arranged approximately centrally between the first carrier end 34 and the second carrier end 42. The deflection roller 54 is mounted in a housing 56 which is screwed to the two carriers 32, 33. The deflection roller 54 is arranged such that it is inserted between the two carriers 32, 33 and deflects a load-bearing means 28 coming from the displacement apparatus 48 such that said means extends vertically downward downstream of the deflection roller 54. The deflection roller 54 is arranged such that the load-bearing means 28 is arranged approximately in the center of the elevator shaft 10 when the installation device 24 is in the installation position.

A second cross member 58 is arranged and screwed to the carriers 32, 33 between the deflection roller 54 and the second carrier end 42. The second cross member 58 has an eyelet 60 to which a cable (not shown) can be fastened. By means of this cable, the installation device can be pivoted into and out of the installation position in a controlled manner.

Figure 4:
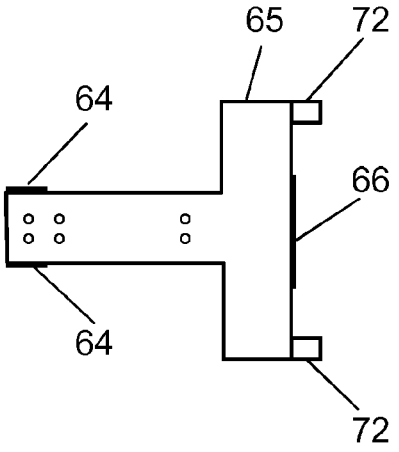
FIG. 4 is a plan view of a mounting plate of the displacement apparatus.
Figure 5:
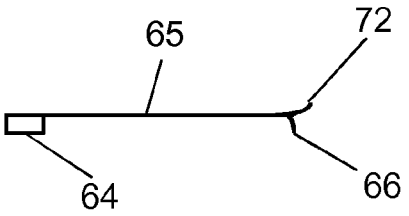
FIG. 5 is a side view of the mounting plate of the displacement apparatus.

The displacement apparatus 48 is not shown in FIG. 3 so that two first alignment elements 62 of the holding apparatus 46 can be seen, which elements are designed as openings. The two first alignment elements 62 interact with two second alignment elements 64 of a mounting plate 65 shown in FIGS. 4 and 5, which second alignment elements are designed as extensions. The mounting plate 65 is screwed to the displacement apparatus 48 from below such that it is arranged between the displacement apparatus 48 and the holding apparatus 46 or the carriers 32, 33 when the installation device 24 is in the mounted state. The mounting plate 65 has a mainly T-shaped basic shape and consists of a metal plate that is a few millimeters thick, the second alignment elements 64 having been formed by bending over corresponding parts of the metal plate. The first alignment elements 62 and the second alignment elements 64 are arranged such that the second alignment elements 64 are inserted into the first alignment elements 62 when the mounting plate 65, and thus the displacement apparatus 48, is positioned in a correct mounting position relative to the holding apparatus 46. The insertion may be referred to as an interaction between the alignment elements 62, 64. If said correct mounting position is reached, the holding apparatus 46 can be screwed to the mounting plate 65, and thus to the displacement apparatus 48.

The mounting plate 65, and thus the displacement element 48, also has a guide element 66. The guide element 66 is also designed as an extension and is formed analogously to the second alignment elements 64 by bending over a corresponding part of the metal plate. The guide element 66 is designed and arranged such that it is inserted between the carriers 32, 33 and is supported laterally thereagainst when the displacement apparatus 48, and thus the mounting plate 65, is pushed onto the holding apparatus 46 and the carriers 32, 33. The two carriers 32, 33 thus form a guide 70 of the installation device 24, which cooperates with the guide element 66 when the displacement apparatus 48 is arranged on the installation device 24.

The mounting plate 65, and thus the displacement apparatus 48, also has two sliding elements 72, which are arranged on the two outer ends of the T-shaped mounting plate 65. The sliding elements 72 are bent slightly upward such that they can slide effectively on the two carriers 32, 33 when the displacement apparatus 48 is arranged on the installation device 24.

Figure 6:
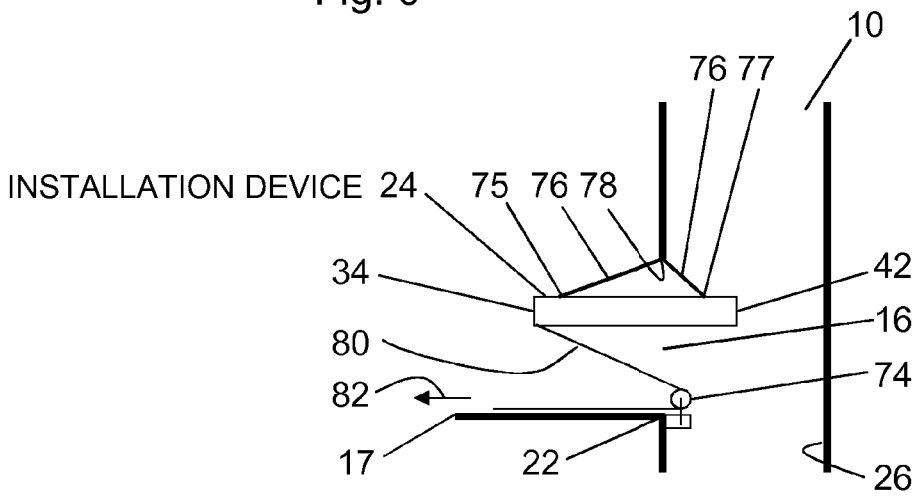
FIG. 6 shows the installation device in a first phase of being brought into the installation position.
Figure 7:
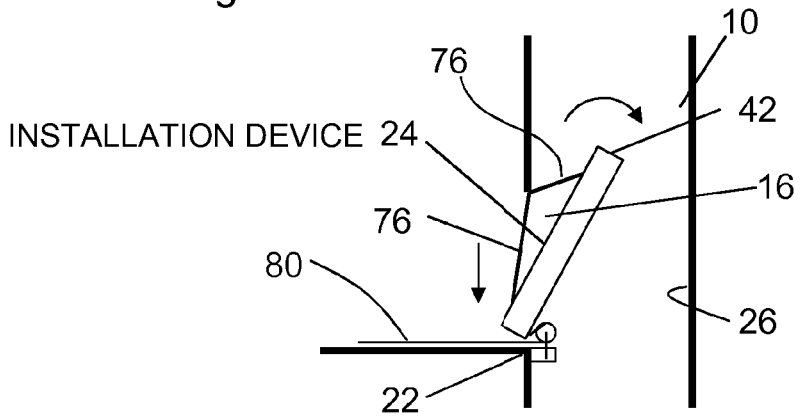
FIG. 7 shows the installation device from FIG. 6 in a second stage of being brought into the installation position.
Figure 8:
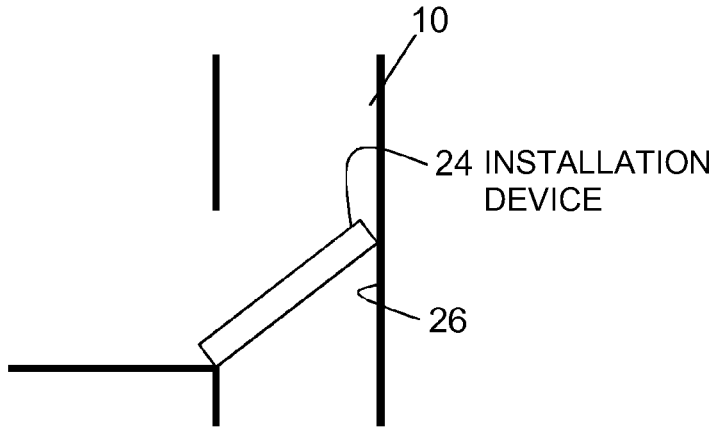
FIG. 8 shows the installation device from FIGS. 6 and 7 in the installation position.

FIGS. 6, 7 and 8 show how the installation device 24 can be brought into its installation position inside the elevator shaft 10 in a particularly simple and safe manner.

As shown in FIG. 6, a deflection element 74 in the form of a deflection roller is first secured, for example screwed, directly below the threshold 22 of the floor 17 and thus in the region of the threshold 22 of the door opening 16. Subsequently, the installation device 24 is suspended from a top 78 of the door opening 16 by means of two load-bearing elements 76 designed as chain pulleys such that the first carrier end 34 is arranged outside the elevator shaft 10 and the second carrier end 42 is arranged inside the elevator shaft. The two load-bearing elements 76 are secured to two suspension points 75, 77 of the installation device 24. The holding apparatus 46 acts as the first suspension point 75 and the eyelet 60 on the second cross member 58 acts as the second suspension point 77.

A third load-bearing means 80 in the form of a cable is then fastened to the first carrier end 34 and guided around the deflection element 74. By pulling on an end of the third load-bearing element 80 that is opposite the first carrier end 34 in a direction 82 which is directed away from the elevator shaft 10, the installation device 24 is pivoted about the top 78 of the door opening 16. The first carrier end 34 is thus moved toward the elevator shaft 10.

The installation device 24 is pivoted until the support element is arranged in a correct position for being secured to the threshold 22 of the door opening 16. If necessary, the length of one or both load-bearing elements 76 is also varied or adapted accordingly for this purpose.

When the support element has reached the correct position, it is secured to the threshold 22 of the door opening 16 by means of screws. This position is shown in FIG. 7.

After the support element has been secured, the installation device 24 is pivoted into the elevator shaft 10 about the threshold 22 of the door opening 16 until the second carrier end 42 is supported against the shaft wall 26 that is opposite the door opening 16, as a result of which the installation position of the installation device 24 shown in FIG. 8 is reached. Before this pivoting, the load-bearing elements 76, 80 are removed and a cable (not shown) is attached to the eyelet 60 of the installation device 24, by means of which cable the pivoting is carried out in a controlled manner.

After the installation device 24 has reached its installation position, the displacement apparatus 48 is arranged on the installation device 24. For this purpose, the displacement apparatus 48 is first placed on the holding apparatus 46 from above by means of the screwed-on mounting plate 65. The tensioning belt 52 is then loosely guided around the displacement apparatus 48 and the two carriers 32, 33 and the tensioning belt 52 is closed. The displacement apparatus 48 is then pushed into the correct position. If the correct position is reached, the displacement apparatus 48 is screwed to the holding apparatus 46 and the tensioning belt 52 is tightened. The displacement apparatus 48 is thus firmly secured to the installation device 24.

In order for it to be possible to guide the load-bearing means 28 around the deflection roller 54, the entire installation device 24 is pivoted toward the door opening 16 by means of the above-mentioned cable and then brought back into the installation position. The pivoting toward the door opening 16 can be repeated, for example if further parts which have been transported upward by means of the load-bearing means 28 from further down in the elevator shaft 10 are intended to be arranged on the installation device 24.

If the installation device is to be removed from the elevator shaft again and detached from the threshold, this can be done in the reverse order of bringing the installation device into the installation position.

Finally, it should be noted that terms such as "comprising," "having," etc. do not preclude other elements or steps and terms such as "a" or "an" do not preclude a plurality. Furthermore, it should be noted that features or steps that have been described with reference to one of the above embodiments may also be used in combination with other features or steps of other embodiments described above.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An installation device for use in an elevator shaft, comprising:

a first carrier having a first carrier end and a second carrier end opposite the first carrier end;

a support element pivotably arranged on the first carrier end;

a holding apparatus for holding a displacement apparatus by which installation material can be displaced in the elevator shaft;

wherein the support element, when the installation device is in an installation position, has the first carrier supported in a region of a door opening of the elevator shaft by the support element;

wherein the second carrier end, when the installation device is in the installation position, supports the first carrier at least indirectly against a shaft wall of the elevator shaft that is opposite the door opening;

wherein the holding apparatus is arranged on an upper side of the installation device when the installation device is in the installation position such that the displacement apparatus held by the holding apparatus is supported on top of the holding apparatus;

wherein the displacement apparatus has at least one guide element arranged to interact with a guide of the installation device when the displacement apparatus is arranged on the holding apparatus;

a deflection roller arranged on the first carrier for deflecting a load-bearing means of the displacement apparatus when the displacement apparatus is arranged on the holding apparatus; and wherein a region of the displacement apparatus that is oriented toward the second carrier end of the first carrier is braced to the first carrier by a tensioning belt.

2. The installation device according to claim 1 wherein the support element is adapted to support the first carrier against a threshold of the door opening when the installation device is in the installation position.

3. The installation device according to claim 1 wherein the holding apparatus includes at least one first alignment element that interacts with a second alignment element of the displacement apparatus when the displacement apparatus is arranged in a predetermined mounting position relative to the holding apparatus.

4. The installation device according to claim 1 including a second carrier arranged at a distance from and in parallel with the first carrier, the first and second carriers forming the guide of the installation device.

5. The installation device according to claim 1 wherein the displacement apparatus has at least one sliding element arranged to slide along at least one of the holding apparatus and the first carrier when the displacement apparatus is arranged on the holding apparatus.

6. A method for bringing an installation device into an installation position in an elevator shaft, the installation device having a first carrier with a first carrier end opposite a second carrier end and a support element pivotably arranged on the first carrier end, and, when the installation device is in the installation position, the first carrier is supported against a threshold of a door opening of the elevator shaft by the first support element and supported at least indirectly against a shaft wall of the elevator shaft that is opposite the door opening by the second carrier end, the method comprising the following steps:

suspending the installation device in a region of a top of the door opening such that the first carrier end is arranged outside the elevator shaft and the second carrier end is arranged in the elevator shaft;

moving the first carrier end toward the elevator shaft;

securing the support element to the threshold of the door opening;

pivoting the installation device about the support element until the second carrier end is supported at least indirectly against the shaft wall that is opposite the door opening;

arranging a deflection element in a region of the threshold such that the deflection element can deflect a load-bearing means that is oriented toward the elevator shaft in a direction away from the elevator shaft;

securing the load-bearing means to the installation device in a region of the first carrier end;

guiding the load-bearing means around the deflection element; and moving the first carrier end toward the elevator shaft by pulling the load-bearing means in the direction away from the elevator shaft.

7. The method according to claim 6 including suspending the installation device by a first load-bearing element and a second load-bearing element and wherein the load-bearing means is a third load-bearing element, the first load-bearing element being secured to a first suspension point of the installation device and the second load-bearing element being secured to a second suspension point of the installation device, and wherein the first and second suspension points are arranged spaced apart in an extension direction of the installation device.

8. The method according to claim 7 wherein a length of at least one of the first and second load-bearing elements can be varied when the installation device is suspended.

9. The method according to claim 6 including arranging a displacement apparatus on the installation device.

* * * * *